United States Patent [19]

Johnson

[11] 4,127,076

[45] Nov. 28, 1978

[54] NEEDLE BAR FRAME FOR A SEWING MACHINE

[75] Inventor: Ralph E. Johnson, Convent Station, N.J.

[73] Assignee: The Singer Company, New York, N.Y.

[21] Appl. No.: 819,085

[22] Filed: Jul. 26, 1977

[51] Int. Cl.[2] ..... D05B 3/02

[52] U.S. Cl. ..... 112/158 R; 112/221

[58] Field of Search ..... 112/221, 220, 158 C, 112/158 R, 157, 159, 184, 213, 206

[56] References Cited

U.S. PATENT DOCUMENTS

| | | | |
|---|---|---|---|
| 1,159,523 | 11/1915 | Miller | 112/184 X |
| 2,662,495 | 12/1953 | Parry | 112/158 R |
| 2,989,016 | 6/1961 | Johnson | 112/158 C |

*Primary Examiner*—H. Hampton Hunter

*Attorney, Agent, or Firm*—Robert E. Smith; Edward L. Bell; William V. Ebs

[57] ABSTRACT

A sewing machine needle bar frame is pivotally supported at a lower end portion on a leaf spring which can bend to permit zigzagging, and the frame is made to follow a curved path, when zigzagging, through the use of a plastic coupling disposed between the upper portion of the needle bar frame and a fixed member in the machine head.

6 Claims, 10 Drawing Figures

NEEDLE BAR FRAME FOR A SEWING MACHINE

BACKGROUND OF THE INVENTION

1. Field of the Invention

The invention relates to improvements in sewing machines. More particularly, the invention is directed to an improved mount for the needle bar of a sewing machine.

2. Description of the Prior Art

It is common practice in sewing machines to provide cylindrical or spherical type bearings at upper and lower portions of needle bars and to cause these bearings to move in such fashion as to impart zigzagging movements to the needle of a sewing machine while the needle is being moved into and out of work being sewed. One well known construction is that shown in U.S. Pat. No. 2,989,016 of R. E. Johnson for Sewing Machines wherein a needle bar is provided with upper and lower spherical bearings, the upper of which is pivoted about a fixed axis and the lower one of which swivels while a needle affixed to the needle bar is thereby caused to trace an arc conforming to an arc of the rotary loop taker of the machine.

In the prior art needle bar mountings for zigzagging machines, the needle bar bearings had to be accurately machined to reliably establish the path of the needle and its position relative to the hook of the rotary loop taker. It was therefor costly to produce these parts.

It is a prime object of this invention to provide a zigzag sewing machine with a stable inexpensive needle bar mounting effective to accurately maintain motion of the sewing needle along a path conforming to the arc of the rotary loop taker of the machine.

SUMMARY OF THE INVENTION

In a sewing machine according to the invention, a frame supporting a needle bar for reciprocation is mounted at a lower end portion on a leaf spring which is secured to a fixed member in the machine head and flexes about a transverse axis to permit zigzagging movements of the frame and needle bar. A flexible plastic coupling connected to the upper end portion of the needle bar frame and fixed member in the machine head causes the needle bar frame and needle bar, when zigzagging, to follow a curved path conforming to the arc of the rotary loop taker of the machine.

DESCRIPTION OF THE PREFERRED EMBODIMENT

Figure 1:
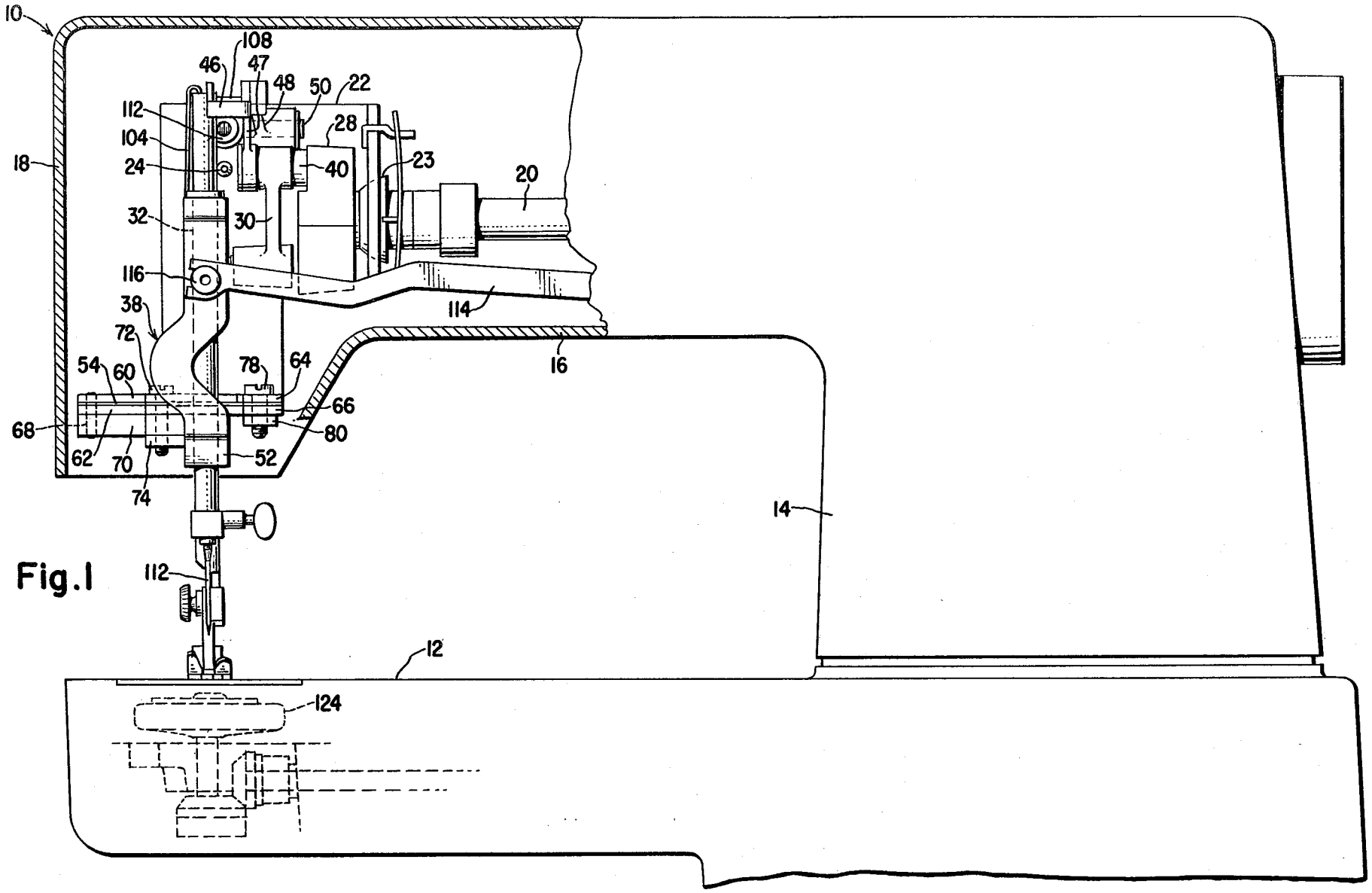
FIG. 1 is a front elevational view of a sewing machine according to the invention with a portion of the housing broken away to show internal parts.
Figure 2:
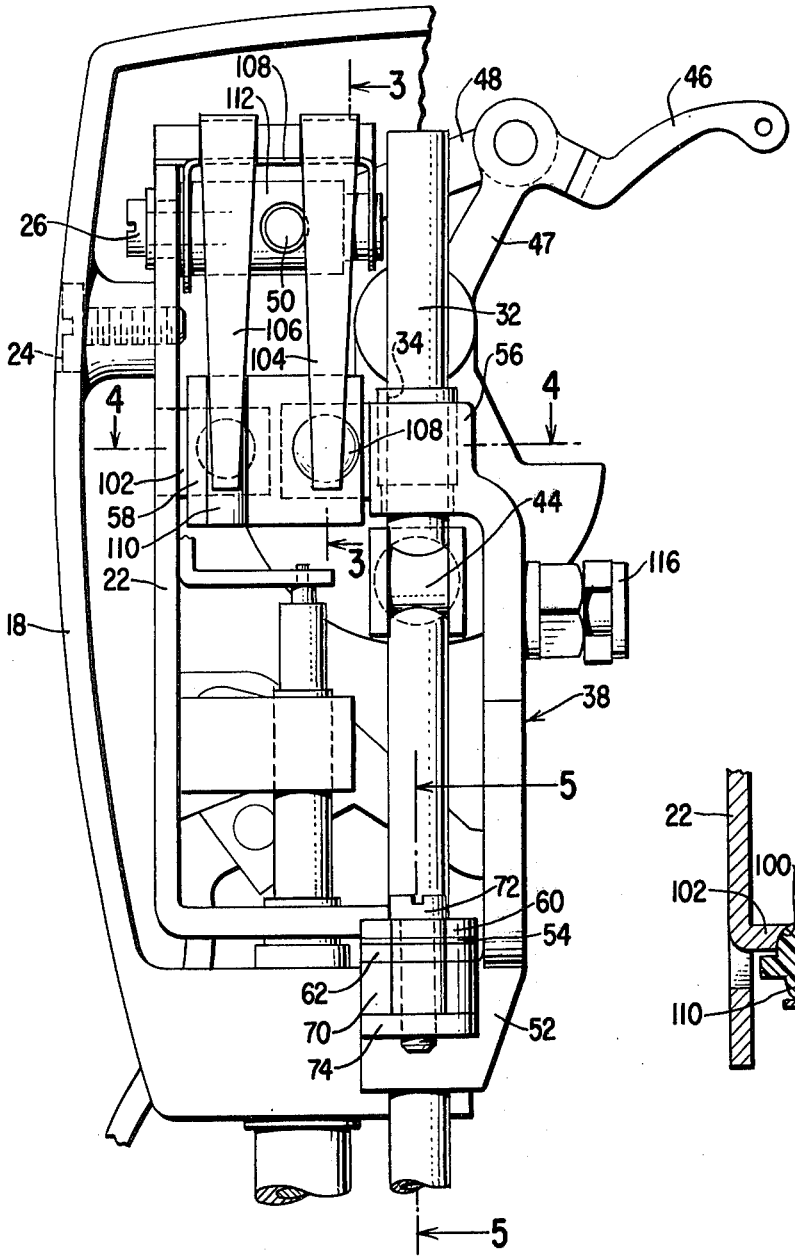
FIG. 2 is an enlarged fragmentary front elevational view showing the needle bar frame and mounting therefor in the machine.
Figure 3:
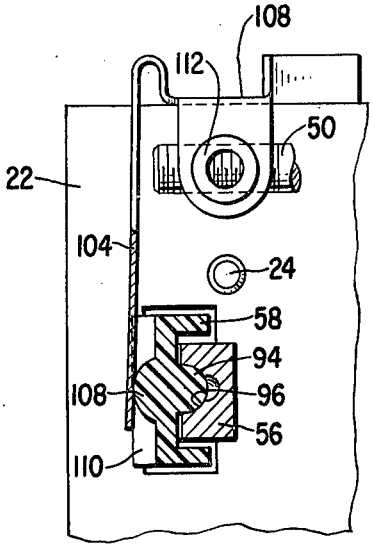
FIG. 3 is a sectional view taken on the plane of the line 3—3 of FIG. 2.
Figure 4:
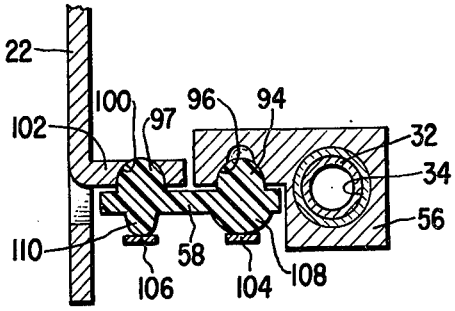
FIG. 4 is a sectional view taken on the plane of the line 4—4 of FIG. 2.
Figure 5:
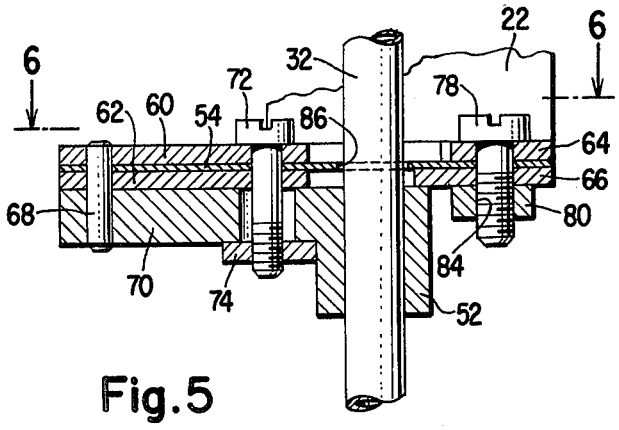
FIG. 5 is a sectional view taken substantially on the plane of the line 5—5 of FIG. 2.
Figure 6:
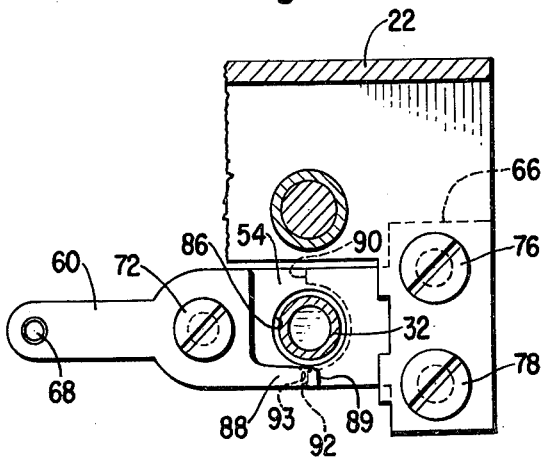
FIG. 6 is a sectional view taken on the plane of the line 6—6 of FIG. 5.
Figure 10:
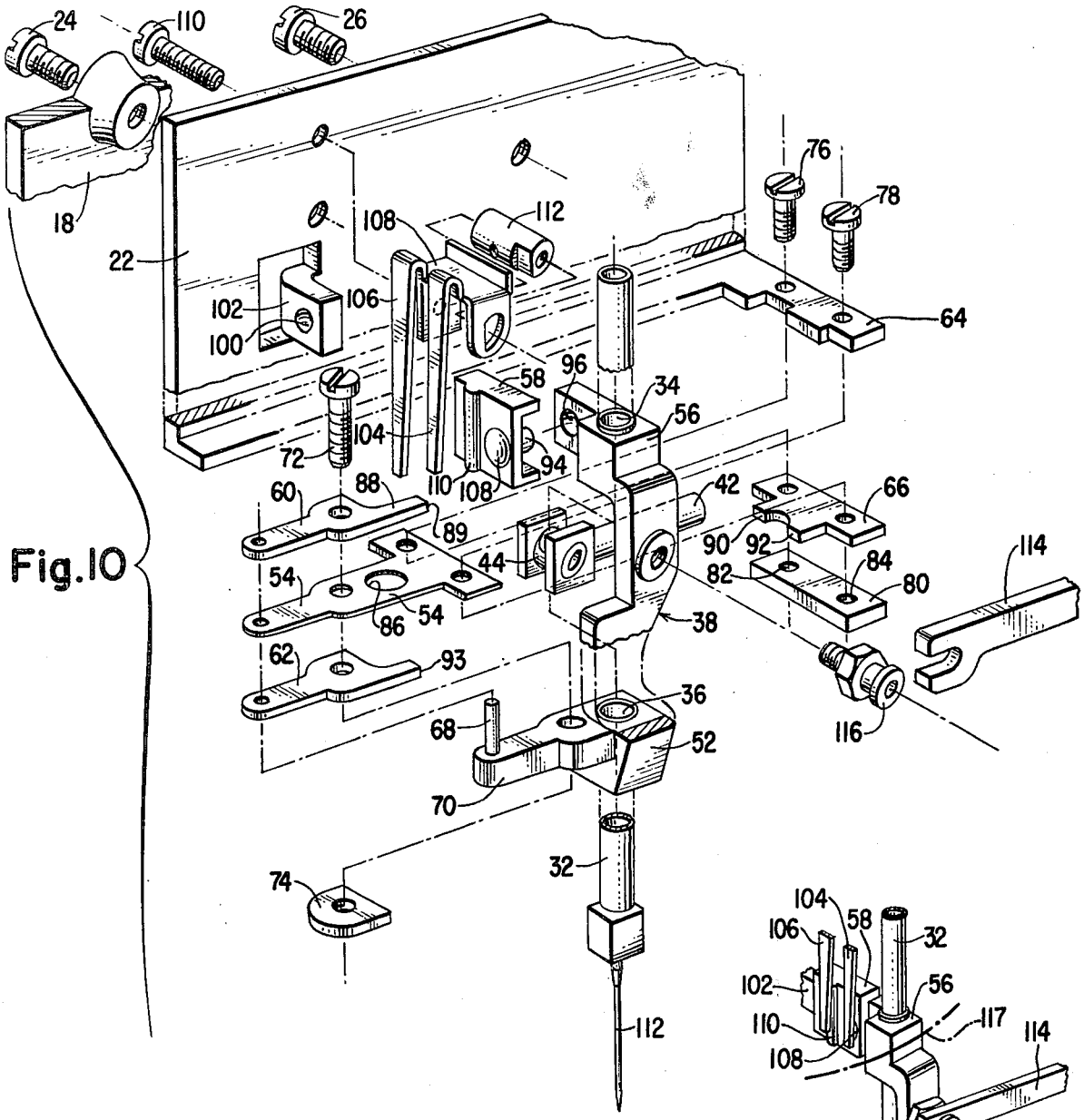
FIG. 10 is an exploded perspective view of the needle bar frame and mounting therefor.
Figure 7:
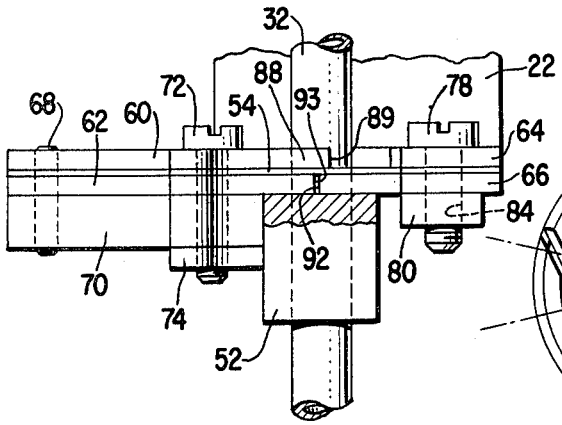
FIG. 7 is a fragmentary front elevational view showing the spring mounting for the needle bar frame of the machine.
Figure 8:
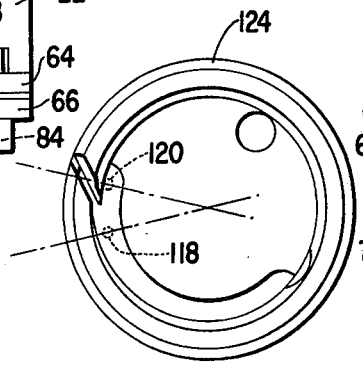
FIG. 8 is a top plan view of the rotary loop taker of the machine.
Figure 9:
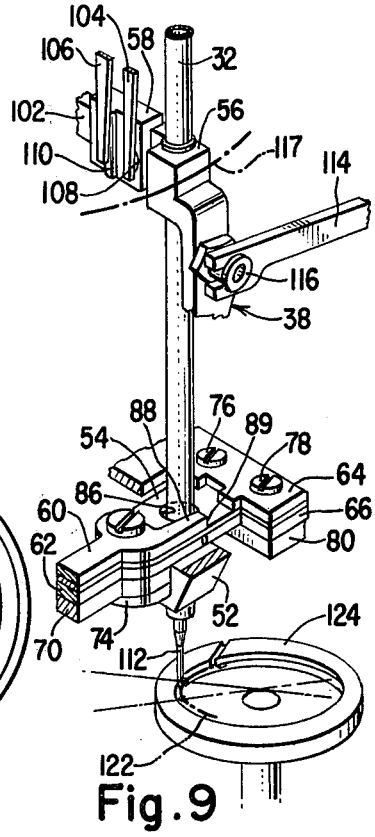
FIG. 9 is a perspective view on a reduced scale illustrating movement of a sewing machine needle with respect to a rotary loop taker of the machine.

Referring to the drawings, reference character 10 designates a sewing machine housing including a base 12, an upright standard 14, and a bracket-arm 16 terminating in a head 18. A main driving shaft 20 is journaled at spaced locations in the frame in bearings including a bearing 23 located in a member 22 which is affixed to the head 18 by screws 24 and 26. The shaft drives a crank 28, and the crank acting through a link 30 imparts vertical reciprocating motion to a needle bar 32 which is slidably mounted in bearings 34 and 36 in a frame 38. As shown, the link 30 is pivotally mounted at one end on a boss 40 which is integral with the crank 28, and the other end is pivotally mounted on a stub shaft 42 which is integral with a sleeve 44 that is affixed to the needle bar 32.

Crank 28 imparts reciprocating movements in a conventional fashion to a needle thread take-up arm 46 which is integral with a link 47 having one end pivoted on boss 40 and the other end pivotally connected to one end of another link 48, the other end of the link 48 being pivotally mounted on a fixed stub shaft 50.

In accordance with the invention, a lower end portion 52 of the frame 38 is supported on a leaf spring 54 and an upper end portion 56 is connected to the member 22 through a flexible plastic coupling 58.

One part of the spring 54 is sandwiched between overlying and underlying members 60 and 62 respectively, and another part of the spring extends therefrom into a sandwiched relationship with an overlying member 64 and underlying member 66. Members 60 and 62 and the spring portion between them are mounted on a pin 68 affixed to an arm 70 of frame 38, and are secured to the arm 70 by a screw 72 and threaded fastener 74. Member 64 is an integral part of fixed member 22, and such member 64 with that portion of spring 54 which extends between members 64 and 66 are secured to the member 66 by screws 76 and 78 and a plate 80 that receives the screws in threaded holes 82 and 84 respectively.

Needle bar 32 extends through a hole 86 in a spring 54 and a finger 88 on the member 60 extends on one side of the needle bar to a point slightly (such as 1/32 inches) beyond the center line of the needle bar. Member 66 extends partially around the needle bar and terminates at 90 and 92 very slightly (as about 1/64 inches) beyond the center line of the needle bar. Member 62 terminates at 93 under finger 88 of member 60 slightly short (as about 1/32 inches) of the needle bar center line.

The plastic coupling 58 connecting the upper end portion 56 of frame 38 to member 22 includes a semispherical projection 94 which rides in a socket 96 located in the frame 38, and includes another semispherical projection 97 which rides in a socket 100 located in a flanged portion 102 of member 22. The coupling 58 is held in an assembled relationship with the frame 38 and flanged portion 102 of member 22 by springs 104 and 106 which bear against protuberances 108 and 110 respectively on the coupling. As shown, the springs are integral parts of a bracket 108 which is secured to member 22 by a screw 110 and threaded fastener 112.

Needle bar 32 is vertically reciprocated as noted, that is, by the crank 28, and a needle 112 at the lower end of the bar is moved to perform a sewing operation. At the same time, an oscillating motion is imparted to the frame 38, and therefor also to needle 112 by a link 114 which is connected to the frame at 116 and is longitudinally reciprocated by the driving mechanism of the machine in customary fashion. The leaf spring 54 and plastic coupling 58 determine the particular manner in which the frame and needle move. The frame pivots while the spring flexes about a transverse axis in the spring substantially in the plane of the center line of the needle bar. In addition, the upper portion of the frame is caused to follow a curved path 117 in a more or less horizontal plane by the coupling 58, and the leaf spring twists slightly to accommodate this motion. The centerline distance between the sockets 96 and 100 wherein the semi-spherical projections 94 and 97 of the plastic coupling ride is such as to provide, between the extreme points of travel 118 and 120 of the needle, a path 122 concentric with the curvature of the rotary loop taker 124 of the machine.

Although the invention has been described in its presently preferred form, it is to be understood that the present disclosure is by way of example only and that numerous changes in construction and in the combination and arrangement of parts may be resorted to without departing from the spirit and scope of the invention.

Having thus set forth the nature of the invention what is claimed herein is:

1. In a sewing machine, the combination comprising a needle bar having a sewing needle at the lower end thereof, a frame wherein the needle bar may reciprocate to move the needle into and out of a work piece, a leaf spring having one end portion affixed in the machine and having another portion affixed to a lower end portion of said frame, the leaf spring being in a plane substantially perpendicular to the needle bar when the needle bar and sewing needle are in a vertical position, means for oscillating the frame on the spring so that the needle moves from one side to another of said vertical position, and a movable coupling extending substantially perpendicular to the needle bar frame, connected at opposite ends to fixed structure of the machine and to the needle bar frame for causing the needle to follow a curved path while the needle bar is moved by the oscillating means.

2. The combination of claim 1 wherein said coupling is formed with semi-spherical projections, and the fixed machine structure and needle bar frame include sockets in which the semi-spherical projections are received.

3. The combination of claim 2 including spring means in engagement with said coupling for holding the semi-spherical projections thereon in the said sockets.

4. The combination of claim 1 wherein said coupling is of a flexible material.

5. The combination of claim 1 wherein said needle bar extends through the leaf spring.

6. The combination of claim 1 including overlying and underlying member means in engagement with the leaf spring defining a transverse bending axis for the spring substantially in the plane of the center line of the needle bar.

* * * * *